United States Patent [19]

Foster

[11] Patent Number: 4,912,750

[45] Date of Patent: Mar. 27, 1990

[54] SPRAY PAINT GUN LIGHT

[76] Inventor: Michael A. Foster, 6613 San Luis St., Paramount, Calif. 90723

[21] Appl. No.: 830,621

[22] Filed: Feb. 18, 1986

[51] Int. Cl.[4] ..... F41G 1/34

[52] U.S. Cl. ..... 362/114; 362/157; 362/109

[58] Field of Search ..... 362/109, 101, 217, 119, 362/120, 157, 171, 178

[56] References Cited

U.S. PATENT DOCUMENTS

| | | | |
|---|---|---|---|
| 397,009 | 1/1889 | Loiss | 362/109 |
| 1,076,943 | 10/1913 | Berg | 362/109 |
| 2,066,028 | 12/1936 | Britsch | 362/109 |
| 2,075,883 | 4/1937 | Britsch | 362/109 |
| 2,413,599 | 12/1946 | Beck | 362/157 |
| 2,435,164 | 1/1948 | Sobel | 362/157 |
| 2,641,685 | 6/1953 | Pessina | 362/157 |
| 2,701,297 | 2/1955 | Thibault | 362/109 |
| 3,812,340 | 5/1974 | Brandt | 362/114 |
| 4,268,893 | 5/1981 | Narrigan | 362/109 |

FOREIGN PATENT DOCUMENTS

| | | | |
|---|---|---|---|
| 463371 | 2/1914 | France | 362/109 |

*Primary Examiner*—Raymond A. Nelli
*Attorney, Agent, or Firm*—Ronald Juniper

[57] ABSTRACT

A spray paint gun with a light connected to the paint gun so that it provides reflection as close as possible directly to the area being painted, without interfering with the spraying operation. It includes a connector for securing a light, preferably fluorescent, to a spray gun so that its refelection is substantially evenly directed from the area being sprayed by perpendicular alignment with the longitudinal axis of the spray gun outlet. Thus, the reflection from the light is generally evenly directed twoward the area being sprayed. Because of the extensive added reflection a painter can see defects, which can be corrected before it is too late, vastly better than prior to this invention.

8 Claims, 2 Drawing Sheets

FIG. 1
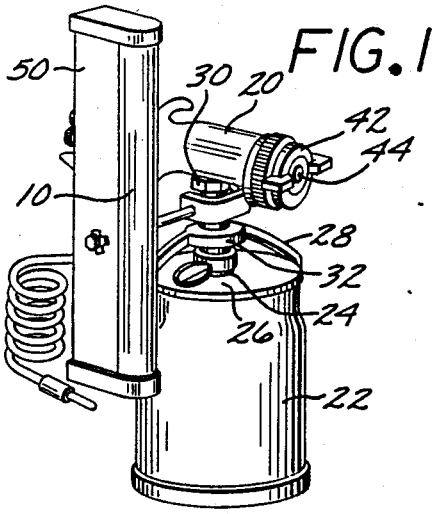
FIG. 2
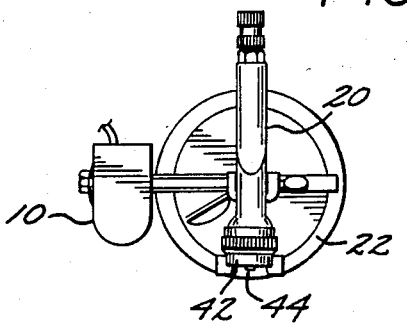
FIG. 4
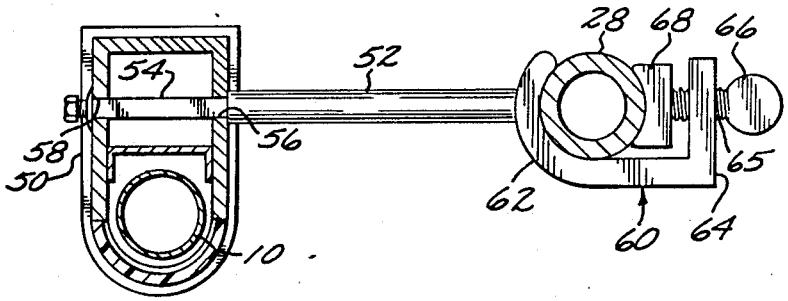
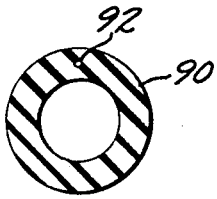
FIG. 7
FIG. 3
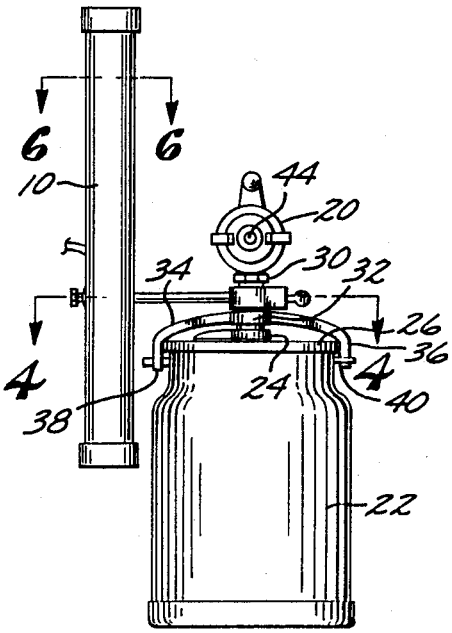
FIG. 5
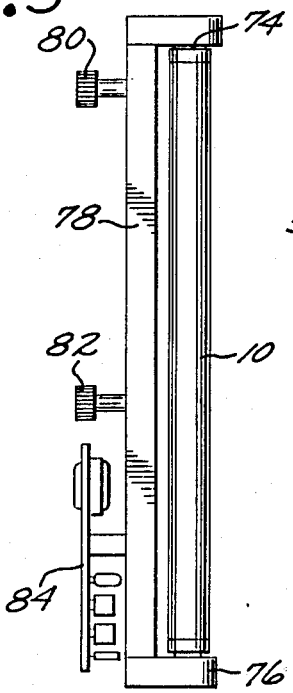
FIG. 6
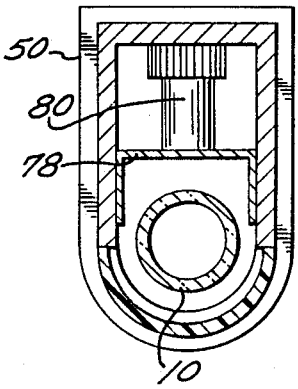

SPRAY PAINT GUN LIGHT

BACKGROUND OF THE INVENTION

This invention relates to solving problems experienced by people trying to achieve the best possible paint job by using a hand spray gun. One of the main problems is that getting the best paint job requires that the finish look just right. This is accomplished by avoiding putting too much paint in an area so that it is too wet and runs or not enough paint so that it is too dry.

Since the amount of time for drying of the paint is critical the application of just the right amount of paint is vital for success. In order to tell whether the amount of paint applied is proper it is important for the painter to be able to clearly see the paint as it is applied.

Thus, since practical painting applications are often done indoors some type of artificial lighting is essential. Prior to this invention this generally consisted of finding lighting fixed in position. These are generally insufficient because they cannot cosistently provide the right amount of light in the proper place. That is, the experienced painter is able to gauge at what rate and where to move his gun as he is painting because of how it looks.

In order to overcome these and other problems in the conventional hand spray paint lighting system the equipment and methods used in this invention have been developed. This system includes lighting equipment which is adjacent to and moves with the spray gun so that the amount of paint applied can be immediately and accurately determined by an experienced painter's observation of the reflection patterns. This is because, in ordinary lighting systems, the painter cannot properly see the painted area because of shadows, varying lighting angles and the obstruction of his own body and equipment between the lights and the area being painted.

SUMMARY OF THE INVENTION

A form of light which solves these problems includes a housing, to hold the light, which is attached directly to the spray gun and is aligned so that the light is pointed with the spray gun toward the area being sprayed. Thus, a consistent reflection pattern can be observed in the spray area and shadows from the painter and equipment eliminated.

Preferably the source of light is fluorescent because this provides an especially vivid reflection of defects in the painting thereby providing the alert painter an opportunity to correct the defects before it is too late.

In order to eliminate potentially dangerous electrical shocks when the equipment is around moisture (which is inevitable) alternating current is avoided by converting it to direct current (by suitable components) before entering the spray area. Also, to most effectively carry the wiring from the current source to the light, it is incorporated with the air hose connector to the spray gun.

DESCRIPTION OF THE DRAWINGS

FIG. 1 is an isometric view of a preferred form of this invention showing a lighted spraying device in operative position for utilization to spray paint.

FIG. 2 is a top plan view of the invention in FIG. 1.

FIG. 3 is a front elevational view of the invention shown in FIG. 1.

FIG. 4 is a cross-sectional view of the invention taken through the plane 4—4 in FIG. 3.

FIG. 5 shows the fluorescent light and holding structure of the device as previously shown.

FIG. 6 is a cross-sectional view taken on the plane 6—6 in FIG. 3 showing the light housing structure.

FIG. 7 is a cross-sectional view of an air hose with electrical wiring incorporated therein.

DETAILED DESCRIPTION OF A PREFERRED EMBODIMENT OF THE INVENTION

Figure 8:
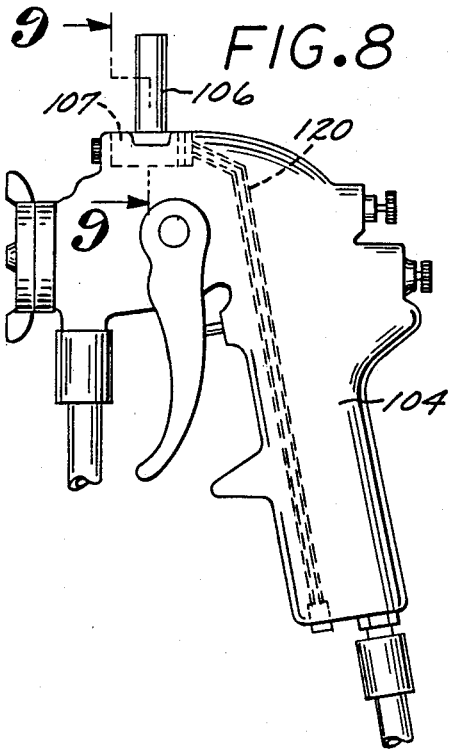
FIG. 8 is an elevational view (with partly ghost internal structure) showing a modified view of a paint spray gun wherein a detachable light connecting apparatus is integrated into the gun.
Figure 9:
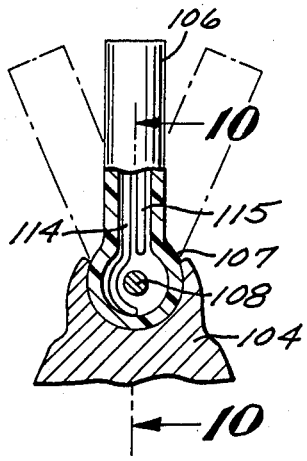
FIG. 9 is a fragmented cross-sectional view taken through 9—9 in FIG. 8 showing the internal structure of the light connecting apparatus.
Figure 11:
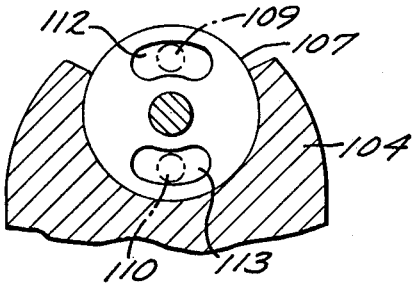
FIG. 11 is a cross-sectional view taken through 10—10 in FIG. 10 showing the electrical circuit contacts.
Figure 10:
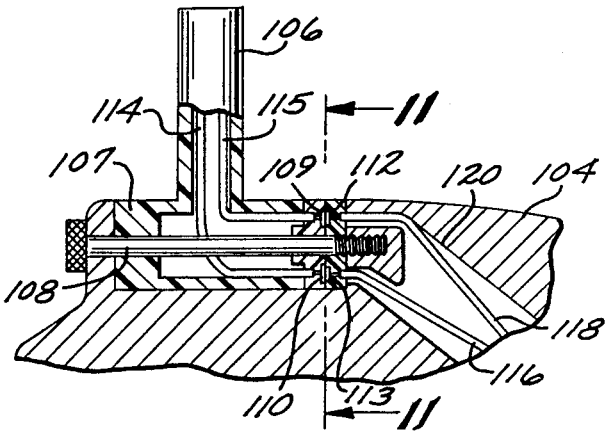
FIG. 10 is a longitudinally-sectioned, partially fragmented view of the light connecting apparatus taken through 10—10 in FIG. 9.
Figure 12:
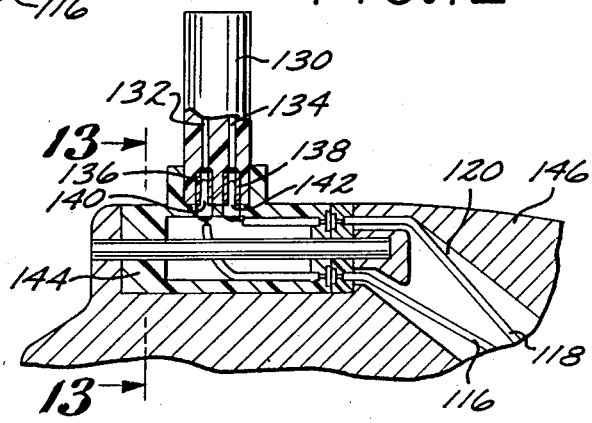
FIG. 12 is a still further modification of this invention similar to that shown in FIGS. 8–11, wherein the light-connecting apparatus can be detached by being unplugged.
Figure 13:
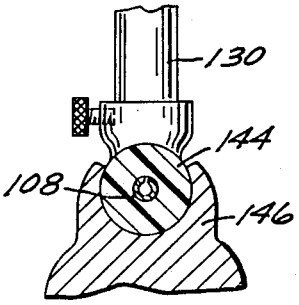
FIG. 13 is a cross-sectional, partly elevational view of the light-connecting apparatus of FIG. 12 taken through 13—13 therein.

Referring to the drawings, a preferred form of this invention, as shown, includes a light 10 adapted to be engaged with a spray gun 20 and operatively connected with a cylindrical, can-type, sealed paint container 22.

The paint container 22 is vented and is provided with an outlet 24 in the center of its top lid 26. A short tube 28 extends upwardly from outlet 24 and is operatively connected to an inlet opening 30 in the bottom of spray gun 20.

Tube 28 is held in place by a spider-type brace which has a center holder section 32 with a center hole adapted to mate with and receive tube 28. Two curved arms 34 and 36, having finger extensions 38 and 40, respectively, extend outwardly from center holder section 32 and grip the diametrically opposite sides of paint container 22 adjacent to and under lid 26.

The spray gun 20 is provided, on its forward end, with a nozzle 42 having a spray outlet 44 communicating by means of an internal hollow center axis to its inlet opening 30 which, in turn, is connected to spray gun 20.

A light housing 50 is attached to the spraying unit by means of connecting rod 52. Rod 52 has a bolt 54 on one end secured to light housing 50 by passing it through complementary openings 56 and 58 in light housing 50. Connected to the other end of rod 52 is a clamp 60 having an inwardly extending curved finger 62 adapted to matingly engage one side of tube 28.

An L-shaped base portion 64 of clamp 60 has a threaded hole 65 through which a matingly threaded adjusting screw 66, having a swivelly mounted head 68, is adapted to matingly engage the opposite side of tube 28.

Thus, by tightening screw 65 the curved inside surface 70 of head 68 presses against tube 28 forcing it, in turn, against the inside gripping curved surface 72 of finger 62. When tightened this provides a very secure attachment for the light 50 to the spray gun 20.

Further more, by making bolt 54 and openings 56 and 58 in light housing 50 through which it is mounted, non-circular, light 10 can be aligned relative to spray gun 20 in predetermined positions. Preferably this is with the elongated longitudinal axis of fluorescent light 10 aligned substantially perpendicularly with the center axis of spray gun 20. This, in turn, causes the paint to be reflection evenly throughout the arc of the spray as the paint is being applied to a surface.

Light 10 is mounted, at its opposing ends 74 and 76, within the mating electrically conductive sockets of a light holder bracket 78 which coextends with the length of light 10 and is adapted to receive and hold it securely in place.

On the back side of bracket 78, opposite from where light 10 is held, a spaced pair of holder screws 80 and 82, extend out and are adjustably mounted therein. These screws 80 and 82 serve as secondary heat sinks and spacers for the bracket 78 when carried within light housing 50.

Electrical circuitry and components 84 are carried by bracket 78 so that suitable energy is provided to light 10. Preferably this is direct current so as to avoid the dangerous high voltages often present with alternating current circuits. Appropriate apparatus is used (not shown) to provide a source of reliable direct current energy. Both the light and the clamp are selected to universally fit a variety of standard sizes. That is, the length and placement of the light will allow it to fit many guns without obstruction because of its specifically selected coordinated adjustment attachment means.

The method of delivering direct current electricity to the spray gun includes electrical circuit wiring which, preferably, is carried by the same air hose which is connected to the spray gun. For safety and convenience conventional alternating current has been transformed to direct current before being carried on the wiring associated with the air hose.

The air hose, in turn, preferably incorporates the electrical wiring to run longitudinally within it, with the wiring sufficiently insulated both from the exterior and interior of the hose by being spaced enough from both surfaces to result in that purpose. Thus, as shown in the cross-sectional view of FIG. 7, an air hose 90 has electrical wiring 92 embedded within the casing of the air hose 90 so as to run longitudinally within the air hose.

One end of the air hose 90 connects with spray gun 22 and the associated wiring 92 extends out the end of the hose to connect electrically with light 50. The other end of air hose 90 is connected with a supply of compressed air and the associated wiring 92 extends out to connect with a source of electricity which has been transformed by suitable components (not shown) to direct current.

In another form of this invention, as shown in FIG. 8, the light 10, as in FIG. 1 is attached as an incorporated device within a paint spray gun 104 which has a specially formed shape adapted to receive light 10 by means of its associated connecting accessories.

The light 10 is attached to the spray gun 104 by means of connecting rod post 106 which is mounted on a hollow spool-shaped connector 107 that is, in turn, movably mounted axially in a matingly-shaped rounded recess in the top of spray gun 104.

Extending axially through 107 is a screw 108 which extends beyond connector 107, at each end, into swivelly mating openings in spray gun 104 so as to provide a movable mounting which, by suitable means can be locked in desired positions and easily released.

The light 10 (as in FIG. 1, but within modified orientation) is still positioned to reflect forward in alignment with the axis of the direction paint is sprayed from gun 104, but this can be adjusted to maximize its fullest potential to illuminate reflections from the surface being painted.

Electrical wiring circuitry is connected through detachable electrical light contacts 109 and 110 which provide means for the flow of electricity to a connected light 10 through suitable extended mating contact areas 112 and 113 in the spray gun 104.

Electrical circuit wires 114 and 115 pass through a hollow portion of spool-shaped connector 107 between light 10 and spray gun 104 and connect with contacts 109 and 110. Since the contacts 109 and 110 are detachable from contacts 112 and 113 the light 10, with its connector 107, can be quickly removed from spray gun 104 without disturbing the electrical circuitry.

Electrical wiring 116 and 118 extends, correspondingly, within the spray gun 104 through a channel 120 which extends from spray gun electrical contact areas 112 and 113 on top to bottom-positioned outside contacts which are connected to an external source of electrical power.

In still another form of this invention a light 10, as in FIG. 1, is connected to a rod 130 which includes circuit wires 132 and 134 therein terminating in female sockets 136 and 138 which are designed to receive mating pins 140 and 142, respectively, that extend upright from spool connector 114 (similar to 107) mounted in spray gun 146. The connecting wiring circuitry to the external power source is similar to that just previously described.

Although a preferred form of this invention has been shown and described herein this is not meant as limitation on the inventive scope of this application which intended to extend to all devices within the spirit of the claims.

What is claimed is:

1. A spray paint gun emitting an even, angular spray dispersion, and a fluorescent light designed to reflect an even, elongated light angularly matching that of the spray gun spray dispersion, said light adapted to be connected to a spray gun which has a center axis terminating in a spray outlet nozzle; and attachment means for connecting said light to a spray paint gun so that the reflection from said light is directed from the area which is sprayed by said paint gun;

and said light has a long axis which is substantially aligned perpendicularly relative to the center axis of said spray gun, said light being so connected to said spray paint gun that said center axis terminates in a spray outlet nozzle which directs the center of spray in alignment with said center axis;

in combination with a source of pressurized air; an air line connecting said paint gun and source of pressurized air; a source of direct current electricity and electrical circuitry incorporated in said air line connecting said source of electricity and said light;

wherein paint sprayed from said gun nozzle is so positioned relative to said connected light that it can be monitored by being placed close enough to, movable with, and aligned with said spray gun so that reflections from said light are produced on surfaces being painted adequate for a user to determine the rate and amount of paint to be sprayed and extent of movement needed by said paint gun to avoid defective paint spraying by critical observation of the reflected light paint spray pattern.

2. A light as defined in claim 1 wherein said light is powered by alternating current converted direct current energy circuitry.

3. A light as defined in claim 1 wherein said spray gun has an inlet tube and said attachment means has an adjustable finger gripping means which attaches to and firmly grasps one side of said tube on one end and a securing means to said light on the other end.

4. A spray gun light as defined in claim 1 in combination with a paint spray gun wherein said light is incorporated into a matingly shaped form of said paint spray gun.

5. A spray gun light as defined in claim 4 wherein said light is detachable.

6. A spray gun light as defined in claim 4 wherein said paint spray gun has a top portion provided with a rounded recess, a hollow spool-shaped connector matingly shaped with and movably mounted in said rounded recess, a light connecting rod post mounted on said spool-shaped connector and a light attached to said light connecting post.

7. A spray paint gun light as defined in claim 3 in combination with a housing wherein said light is contained in said housing, electrical circuitry within said housing for connecting said light to a source of electricity and holding means for said light within said housing.

8. A spray paint gun light as defined in claim 7 which includes fixed securing means for connecting to said attachment means wherein said fluorescent light has an elongated longitudinal axis and said longitudinal axis is held in perpendicular alignment with said center axis of said spray gun by said attachment means.

* * * * *